United States Patent [19]

Berich

[11] Patent Number: 4,648,642

[45] Date of Patent: Mar. 10, 1987

[54] SECURITY CHAIN LOCK FOR DOORS

[76] Inventor: John J. Berich, 7518 Forest View Dr., St. Louis, Mo. 63121

[21] Appl. No.: 723,075

[22] Filed: Apr. 15, 1985

[51] Int. Cl.[4] ..... E05C 17/36

[52] U.S. Cl. ..... 292/264; 70/143

[58] Field of Search ..... 70/143; 292/264, DIG. 61, 292/DIG. 44; 24/116 R

[56] References Cited

U.S. PATENT DOCUMENTS

| | | | |
|---|---|---|---|
| 198,553 | 12/1877 | Von Auer | 292/264 |
| 2,704,218 | 3/1955 | Claud-Mantle | 292/113 |
| 3,338,612 | 8/1967 | Howard | 292/DIG. 44 X |
| 3,796,450 | 3/1974 | Schulz | 292/264 |
| 4,422,678 | 12/1983 | Tuckett et al. | 292/264 |

FOREIGN PATENT DOCUMENTS

| | | | |
|---|---|---|---|
| 309742 | 12/1918 | Fed. Rep. of Germany | 292/264 |
| 554831 | 7/1932 | Fed. Rep. of Germany | 292/264 |
| 2114206A | 8/1983 | United Kingdom | 292/264 |

*Primary Examiner*—Richard E. Moore

*Attorney, Agent, or Firm*—Polster, Polster & Lucchesi

[57] ABSTRACT

A chain door lock includes first part attached to a door adjacent the free edge of the door, a second part attached to the door jamb, and a chain attached to the second part and removably attached to the first part. The first part includes a horizontal spring chamber, a slide element within the spring chamber, a chain holder attached to the slide element, and a shock-absorbing coil spring between the slide element and the spring chamber. The second part includes a leaf spring. The chain is sufficiently long that the door may be partially opened without compressing either spring. The coil spring is sized to absorb a substantial impact, as from the body of a would-be intruder.

17 Claims, 8 Drawing Figures

SECURITY CHAIN LOCK FOR DOORS

BACKGROUND OF THE INVENTION

This invention relates to security chain locks for doors, and particularly to an improved chain lock which resists forced entry better than presently known chain locks.

Security chain locks for doors have long been known. Their function is to permit a door to be cracked open from within, without permitting a person outside the door to enter. Generally, they allow the door to open sufficiently to see the outside, but less than six inches. Such locks include a first keeper element attached to the door, near the free vertical edge of the door, a second keeper element on the door frame, and a flexible element connected between the first and second keeper elements. The second keeper element is mounted adjacent the first keeper element on the door frame. It will be understood that the "frame" may be the side jamb, casing or trim, depending on the construction of the door and the length of the screws holding the second keeper element. The flexible element is traditionally a chain, although other flexible elements such as cables are also sometimes used. Any such flexible element will be referred to hereinafter as a chain.

A traditional chain lock is vulnerable to forced entry. The traditional chain lock is effective against casual intruders, but when a person of substantial size throws his or her weight against the door or kicks the door, one of the keeper elements frequently pulls out of the door frame or door. Therefore, the chain lock frequently gives a false sense of security and in some ways is worse than nothing. The problem may be reduced by using longer, heavier screws to attach the keeper elements, but there are practical limitations to this solution.

SUMMARY OF THE INVENTION

One of the objects of this invention is to provide a security chain lock for doors which is less easily subject to forced entry than presently known chain locks.

Another object is to provide such a chain lock which tends to close a door after an attempted forced entry.

Another object is to provide such a chain lock which installs and operates as easily as a traditional chain lock.

Another object is to provide such a chain lock which is neat and attractive in appearance.

Another object is to provide such a chain lock which is easy and inexpensive to manufacture.

Other objects will occur to those skilled in the art in light of the following description and accompanying drawings.

In accordance with this invention, generally stated, a security chain lock is provided including a first keeper element secured to a door near the free edge of the door, a second keeper element secured to the door frame, and a chain attached between the first keeper element and the second keeper element. The chain is slack when the door is closed and is pulled taut only when the door is cracked open. The chain is removable from at least one of the first and second keeper elements when the door is closed, but it can not be removed when the chain is pulled taut. At least one of the first keeper element and the second keeper element includes spring means for absorbing shock loads applied to the first and second keeper elements when the door is partially opened and the chain is pulled taut.

The chain is preferably a multi-link chain.

The first keeper element preferably includes a horizontal spring chamber and a slider element mounted in the spring chamber. The slider element is U-shaped and includes a pair of horizontal legs extending toward the free edge of the door, through an end wall of the spring chamber. Coil compression springs surround each leg of the U-shaped slider and abut the end wall of the spring chamber. A chain holder engages the cross-bar of the U-shaped slider and releasably holds the end of the chain. Preferably, the springs require at least seventy pounds pressure for complete compression. Also preferably, they can be compressed at least one inch. The first keeper element may be mounted directly at the edge of the door or may be set back from the edge as much as a few inches, and any such positioning is referred to herein as "near" the edge of the door. Preferably, the first keeper element is spaced somewhat from the edge of the door to assure that the pull of the chain is generally in the direction of movement of the slide element.

The second keeper element is preferably formed of a single piece of sheet material, bent to form a post and a keeper loop. One end of the chain is trapped between the post and the keeper loop. The keeper loop also provides a spring action when the chain is pulled taut.

Other aspects of the invention will best be understood in light of the following description of the preferred embodiments.

DESCRIPTION OF THE PREFERRED EMBODIMENT

Figure 1:
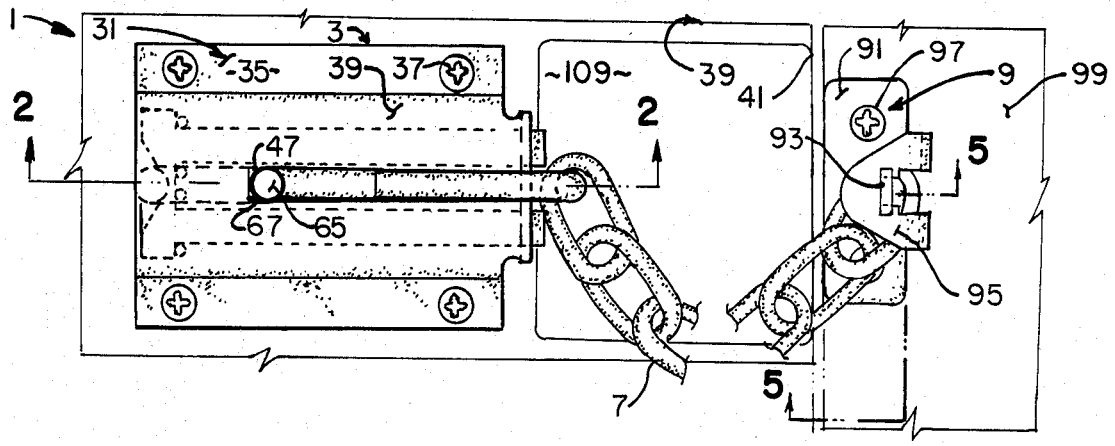
FIG. 1 is a view in front elevation of one embodiment of security chain lock of the present invention.
Figure 2:
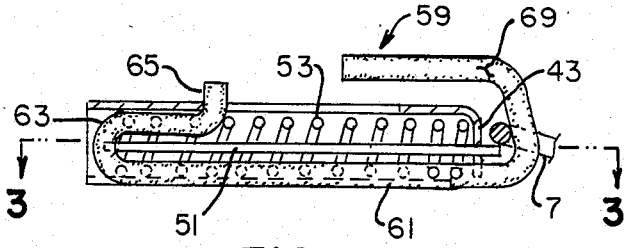
FIG. 2 sectional view taken along line 2—2 of FIG. 1 of a first keeper element of the chain lock.

Referring now to the drawings, reference numeral 1 indicates one illustrative embodiment of security chain lock of the present invention. The chain lock 1 includes a first keeper element, indicated generally at 3, a chain 7, and a second keeper element 9.

The first keeper element 3 includes a 16-gage steel plate 31, bent to form a central horizontal spring chamber 33 and a pair of attachment flanges 35. When bent, the plate 31 is about two-and-one-half inches long, two inches wide, and one-half inch high. The flanges are held by screws 37 to a door, indicated generally at 39. The first keeper element 3 is spaced about two inches from the free vertical edge 41 of the door 39. The end of the spring chamber 33 near the edge 41 of the door 39 is bent downward to form a wall 43 having a pair of openings 45 in it. A horizontal slot 47 is provided in the upper surface of the spring chamber 39.

In the horizontal spring chamber 39 is a slider element 49 formed of 16-gage sheet steel. The slider element 49 is U-shaped and includes a pair of horizontal legs 51 extending toward the free edge 41 of the door, through the openings 45 in end wall 43 of the spring chamber 39. Coil compression springs 53 surround each leg 51 of the U-shaped slider 49 and abut the end wall 43 of the spring chamber 39. The cross-bar 55 of the slider element 49 extends outwardly slightly beyond the legs 51, to act as an abutment for the springs 53. The springs 53 are each two-and-one-half inches long in their uncompressed condition and are compressed to a two-and-three-eighths-inch length in the spring chamber 39, as explained hereinafter. The springs require about seventy-five pounds pressure for complete compression to a length of about one and one-half inches.

The cross-bar 55 of the slider element 49 is notched as indicated at 57 to accept a bent wire chain holder 59. The chain holder 59 is made of three-sixteenths inch steel wire. It is bent to form a straight horizontal lower section 61 having a hair-pin bend 63 at one end for engaging the notch 57, an upturned stop portion 65 for engaging the end 67 of the slot 47, and an upturned U-bend 69 at its free end adjacent the free edge 41 of the door. The U-bend 69 acts to hold the chain 7. The lower edge of the wall 43 is cut out to accommodate the chain holder 59. It will be seen that with the slider element 49, springs 53, and chain holder 59 assembled, the springs are somewhat compressed between the end wall 43 and the cross-piece 55 of the slider element 49, because the slider element is held forward by stop 65 on the chain holder 59.

The chain 7 is approximately five inches long. It is formed of one-eighth inch hardened steel wire links.

The second keeper part 9 is formed of one-sixteenth inch (16 gage) sheet steel bent to form a mounting plate part 91, a chain post 93, and a chain guard 95. The mounting plate part 91 is attached by screws 97 to a frame 99 of the door 39. The screws 97 preferably extend through the side casing of the frame 99 into the jamb. The second keeper part 9 is preferably mounted along the edge of frame 99.

The chain post 93 includes a body part 101 and an enlarged head part 103. The chain guard 95 includes a slot 105 having a narrowed portion 107 toward the free end of the chain guard 95. The chain guard is bent over and around the chain post 95, so that the chain post extends through the narrowed portion 107 of the slot 105 and chain guard 105 extends around and traps the chain 7 on the post 93.

The preferred security chain lock system 1 also includes a plate 109 adhered to the door 39 between the first keeper part 3 and the free vertical edge 41 of the door. The plate 109 acts as a slide plate to protect the door from the chain 7.

In the construction of the security chain lock 1, springs 53 are placed on the slider part 49, and the slider part 49 is inserted into the slots 45 in the end wall 43 of the spring chamber 39. The springs 53 are further compressed and the chain holder 59 is slipped onto the slider part 49 from below the first keeper part 3. The springs 53 then hold the first keeper part 3 assembled until the part 3 is assembled to a door.

Figure 5:
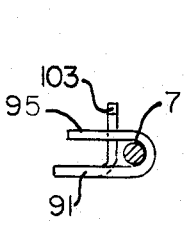
FIG. 5 is a sectional view taken along line 5—5 of FIG. 1 of a second keeper element of the chain lock.
Figure 6:
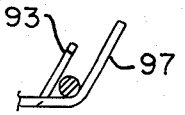
FIG. 6 is a sectional view corresponding to FIG. 5, showing the second keeper element partially formed.
Figure 3:
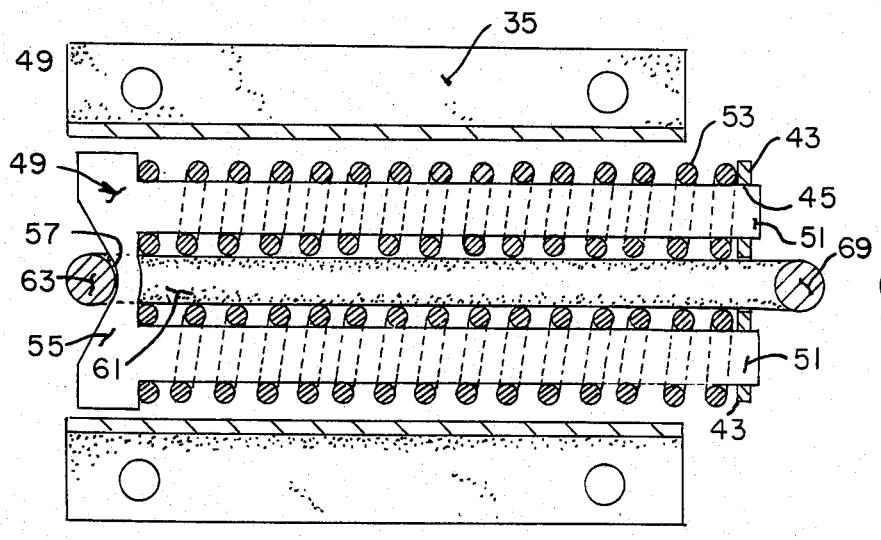
FIG. 3 is a sectional view taken along line 3—3 of FIG. 2, with a chain removed for clarity.
Figure 4:
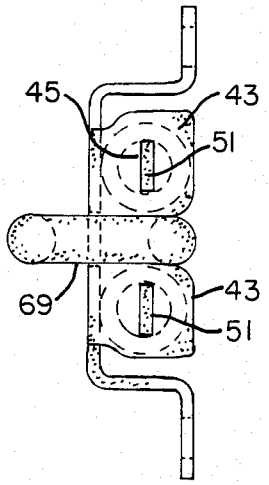
FIG. 4 is a view in right end elevation, as viewed in FIGS. 1–3, of the first keeper element of FIGS. 2 and 3.
Figure 7:
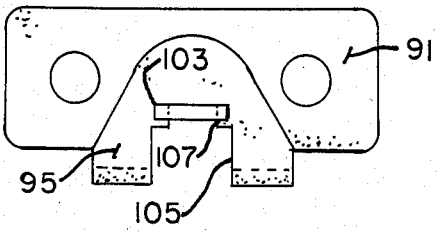
FIG. 7 is an enlarged view, corresponding to FIG. 1, of the second keeper element of FIG. 5, with the chain removed for clarity.
Figure 8:
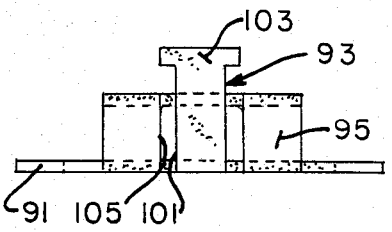
FIG. 8 is a view in right end elevation, as viewed in FIGS. 1 and 5, of the second keeper element of FIGS. 5–8.

The chain post 93 is partially bent up from a flat blank, as is the chain guard 95, as shown in FIG. 6. One end of the chain is placed over the post 93. The chain guard 95 is then bent around the post 93 and the end of chain 7. The post 93 is then bent to a full upright position as shown in FIGS. 5, 7 and 8.

When the security chain lock 1 is installed on the inside of an inwardly opening door and the door is closed, the chain 7 is easily hooked onto the loop 69 of the chain holder 59. With the door closed, the chain hangs in a loose loop. The door may be opened about three inches before the chain pulls taut. At this point, it will be seen that the pull on the first keeper part 3, through the chain holder 59, is essentially along the plane of the door; the pull on the second keeper part 9 is largely away from the plane of the door frame. Therefore, the screws 97 are under a load which has a large component of tension as well as shear, and they would tend to pull out if subjected to a sudden shock load, such as shoving or kicking the door. This is precisely the situation with a conventional chain lock.

Should such a load be placed on the security chain lock 1 of the present invention, however, the load will largely be taken by two types of spring action. The primary spring action is the compression of the springs 53 as the slider element 49 moves toward the free edge 41 of the door 39. The compression springs provide a well controlled and progressive resistance to the force applied to them and greatly reduce the shock load applied to the screws 97 and 37. Pressure applied to the door 39 will also cause the chain 7 to pull the chain guard 95 of the second keeper part 9 upward. The chain guard 95 thus acts as a leaf spring until it moves upward approximately one-quarter inch and strikes the head 103 of the chain post 93.

It will also be seen that the reactive forces of the springs 53 and the chain guard 95 will tend to slam the door 39 as soon as pressure on the door is released.

It will be seen that the security chain lock 1 of the present invention operates in precisely the same manner as an ordinary chain lock until a substantial force is placed on the door. When such a force is placed on the door, the chain lock of the present invention has been found to withstand forces several times greater than those required to tear a conventional chain lock from a door frame or door.

Numerous variations in the security chain lock of the present invention, within the scope of the appended claims, will occur to those skilled in the art in light of the foregoing disclosure. Merely by way of example, the internal construction of the first keeper element 3 may be varied considerably. For example, the slider part and the chain holder could be combined, a single spring could be utilized, or a different attachment of the spring to the chain holder could be utilized. The slide plate 109 may be made an integral part of the first keeper element 3. It is possible, although less desirable, to utilize springs other than compression springs in the first keeper element. As noted, the chain may be a cable or the like. The second keeper element may be formed differently, and the spring action of the second keeper element may be eliminated, although such a construction reduces the effectiveness of the security chain lock. The spring action may also be placed wholly in the second keeper element, although this construction is believed to be more bulky and is not preferred. The chain may be permanently attached to the first keeper element and removable from the second keeper element. These variations are merely illustrative.

I claim:

1. In a security chain lock comprising a first keeper element adapted to be secured near a free vertical edge of a door, a second keeper element adapted to be secured to a door frame adjacent said first keeper element, and a chain, normally attached to and extending between said first keeper element and said second keeper element and being removably attached to at least one of said first keeper element and said second keeper element, said chain having a length sufficient to be normally slack, the improvement wherein said first keeper element includes a horizontal spring chamber, a u-shaped slider part slidably mounted in said spring chamber and operatively connected to said chain, said slider part including a pair of horizontal legs extending through an end wall of said spring chamber, and spring means for absorbing shock loads applied to said first and second keeper elements when said chain is pulled taut, said spring means comprising at least one coil compression spring mounted in said spring chamber for compression by said slider part.

2. The improvement of claim 1 wherein said spring means comprise coil compression springs surrounding each leg of said U-shaped slider and abutting said end wall of said spring chamber.

3. The improvement of claim 1 further comprising a chain holder engaging a cross-bar of said U-shaped slider, said chain holder releasably holding an end of said chain.

4. The improvement of claim 1 wherein said spring means absorbs at least seventy pounds before complete compression.

5. The improvement of claim 4 wherein said spring means absorbs at least one hundred fifty pounds and compresses at least two inches before complete compression.

6. The improvement of claim 1 wherein said first keeper part is adapted to be spaced from a free vertical edge of a door by one to three inches, and including plate means adapted to be mounted adjacent said first keeper part to protect a door on which they are mounted from said chain.

7. The improvement of claim 1 wherein said claim is a multi-link chain.

8. The improvement of claim 1 wherein said second keeper element comprises a bent chain guard part, said chain guard part being positioned to be at least partially straightened as said chain is pulled taut, thereby absorbing shock loads exerted by said chain part.

9. In a security chain lock comprising a first keeper element adapted to be secured near a free vertical edge of a door, a second keeper element adapted to be secured to a door frame adjacent said first keeper element, and a chain, normally attached to and extending between said first keeper element and said second keeper element and being removably attached to at least one of said first keeper element and said second keeper element, said chain having a length sufficient to be normally slack, the improvement wherein said second keeper element is formed of a single piece of sheet material, bent to form a post and a keeper loop, at least one of said post and keeper loop being formed and positioned to absorb shock loads by deformation when said chain is pulled taut.

10. The improvement of claim 9 wherein one end of said chain is trapped between said post and said keeper loop, said keeper loop acting as a leaf spring when said chain is pulled taut.

11. The improvement of claim 9 wherein said post includes a head part extending through said keeper loop, said head part limiting the extent of deformation of said post and keeper loop and maintaining attachment of said chain to said second keeper element when said chain is pulled taut.

12. The improvement of claim 9 wherein said first keeper element includes spring means operatively connected to said chain when said chain is attached between said first and second keeper elements, said spring means absorbing shock loads applied to said first and second keeper elements when said chain is pulled taut.

13. In a security chain lock comprising a first keeper element adapted to be secured near a free vertical edge of a door, a second keeper element adapted to be secured to a door frame adjacent said first keeper element, and a chain permanently attached to said second keeper element and removably attached to said first keeper element, said chain being formed of a plurality of links and having a length sufficient to be normally slack, the improvement wherein said first keeper element includes attachment means for engaging a link of said chain, said attachment means including a hook part opening away from said second keeper element for releasably holding said chain when said chain is slack and for preventing removal of said chain from said attachment means when said chain is taut, and spring means in said first keeper element, said spring means being operatively connected to said attachment means for absorbing shock loads applied to said first and second keeper elements when said chain is pulled taut, and wherein said second keeper element is formed of a single piece of sheet material, bent to form a post and a keeper loop for permanently holding said chain, at least one of said post and keeper loop being formed and positioned to absorb shock loads by deformation when said chain is pulled taut.

14. The improvement of claim 13 wherein said post includes a head part extending through said keeper loop, said head part limiting the extent of deformation of said post and keeper loop and maintaining attachment of said chain to said second keeper element when said chain is pulled taut.

15. The improvement of claim 3 wherein said chain holder is bent to form a hook part for releasably holding said chain.

16. The improvement of claim 15 wherein said chain formed of multiple links, said hook part being adapted to engage one of said links.

17. The improvement of claim 3 wherein said spring barrel is formed of sheet metal, bent to form a chamber, open on one side, and a pair of attachment flanges for attaching said barrel to a door.

* * * * *